United States Patent [19]

Tanzawa et al.

[11] Patent Number: 4,595,280

[45] Date of Patent: Jun. 17, 1986

[54] BLADE CLEANING DEVICE

[75] Inventors: Misao Tanzawa; Kinzi Saito, both of Kawasaki; Ichiro Fukushima, Tokyo, all of Japan

[73] Assignee: Ricoh Company, Ltd., Tokyo, Japan

[21] Appl. No.: 556,298

[22] Filed: Nov. 30, 1983

[30] Foreign Application Priority Data

Dec. 2, 1982 [JP] Japan ..... 57-210579
Dec. 17, 1982 [JP] Japan ..... 57-220338

[51] Int. Cl.[4] ..... G03G 21/00
[52] U.S. Cl. ..... 355/15; 15/256.51
[58] Field of Search ..... 355/3 R, 15; 15/256.51, 15/256.52

[56] References Cited

U.S. PATENT DOCUMENTS

| | | | |
|---|---|---|---|
| 3,724,019 | 4/1973 | Shanly | 355/15 X |
| 4,007,982 | 2/1977 | Stange | 355/15 |
| 4,032,229 | 6/1977 | Tani et al. | 355/15 |
| 4,247,196 | 1/1981 | Ogawa et al. | 355/15 |
| 4,357,098 | 11/1982 | Endo | 355/15 |
| 4,451,140 | 5/1984 | Saito | 355/15 |
| 4,502,779 | 3/1985 | Kajita et al. | 355/15 |

*Primary Examiner*—Fred L. Braun
*Attorney, Agent, or Firm*—Oblon, Fisher, Spivak, McClelland & Maier

[57] ABSTRACT

A blade cleaning device for removing toner particles remaining on the surface of a photosensitive member after image transfer and which includes a blade which is pressed against the surface and a link supporting mechanism for supporting the blade. In one aspect of the present invention, a spring is provided as connected to the link supporting mechanism mainly to keep the blade in pressure contact with the surface and a coil spring is provided in a node of the link mainly to cancel out any fluctuations imparted to the blade, thereby allowing the blade to be kept in pressure contact with the surface at a desired pressure level at all times. In another aspect, the device is so structured that the blade may be located at an operative position where it is in pressure contact with the surface or at an inoperative position where the blade is separated away from the surface. The device may also be so structured that the blade may be moved sideways in a reciprocating manner while being kept in pressure contact with the surface.

16 Claims, 11 Drawing Figures

Fig. 3
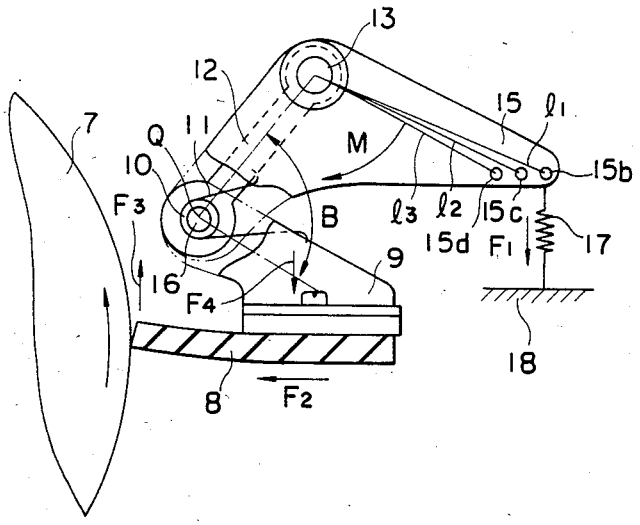
Fig. 5
Fig. 4
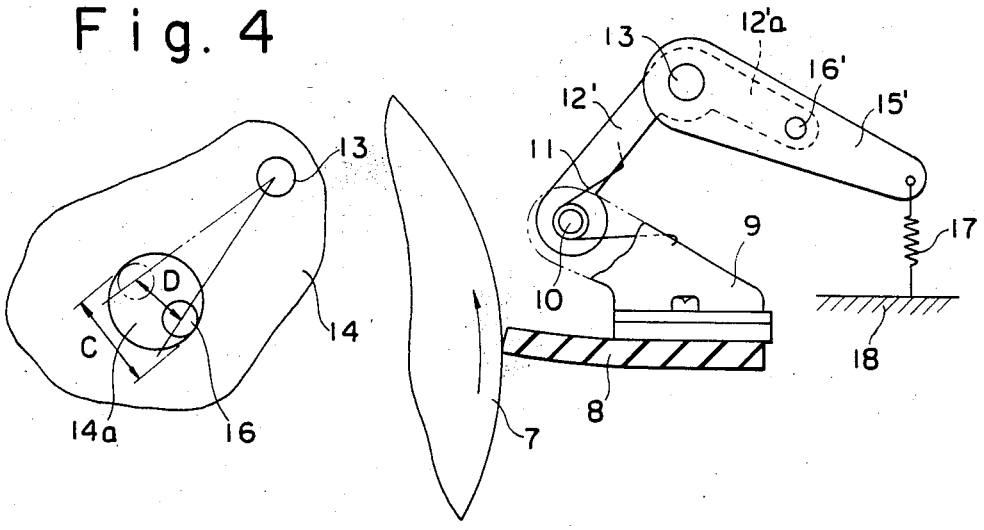

BLADE CLEANING DEVICE

BACKGROUND OF THE INVENTION

1. Field of the Invention

This invention generally relates to a cleaning device for removing particles such as toner particles present on a surface, and more particularly, to a blade cleaning device for removing toner particles remaining on an imaging surface after transfer of a toner image to a transfer medium. More specifically, the present invention relates to a blade cleaning device which is particularly suited for use in electrophotographic copying machines and the like.

2. Description of the Prior Art

Typically, as shown in FIG. 1, the prior art blade cleaning device for removing residual toner particles from the surface of a photosensitive member after transfer of a toner image to a transfer medium includes a blade 2 in pressure and scrubbing contact with the surface of an image bearing member 1, such as a photosensitive drum, a supporting member 3 for supporting the blade 2, a rotatably supported shaft 4 to which the supporting member 3 is fixedly mounted, a lever 5 which is also fixedly mounted on the shaft at one end and a spring 6 extending between the other end of the lever 5 and a stationary object such as a machine housing whereby the force of spring 6 produces a moment in the direction indicated by M around the shaft 4 thereby allowing to keep the tip end of the blade 2 adjustably in pressure contact with the surface of the drum 1 at all times. In this case, the angle A formed between the supporting member 3 and the lever 5 is critical in determining the pressing force of the blade 2 applied by the spring 6 against the surface of the drum 1. Thus, it is often required to set the angle A relatively accurately at the time of assembling or maintenance using a special tool; however, such an operation is rather difficult and time consuming, requiring necessary skill and experience by assembly and maintenance personnel.

Moreover, in order to remove residual toner particles completely, it is necessary to keep the blade in pressure contact with the imaging surface to be cleaned as thoroughly as possible. However, in this case, wear of the imaging surface becomes appreciable. Thus, there is a seemingly contradictory requirement to be met here, i.e., high cleaning efficiency and long service life.

SUMMARY OF THE INVENTION

Therefore, it is a primary object of the present invention to provide an improved cleaning device for removing particles from a surface at high efficiency at all times.

Another object of the present invention is to provide a blade cleaning device for removing residual toner particles from an imaging surface efficiently for an extended period of time.

A further object of the present invention is to provide a blade cleaning device including a cleaning blade which may be adjustably kept in pressure contact with a surface to be cleaned thereby allowing to remove particles remaining on the surface to be cleaned efficiently.

A still further object of the present invention is to provide a blade cleaning device including a cleaning blade which may be desirably moved away from a surface to be cleaned thereby preventing both the blade and the surface from being worn unnecessarily.

A sill further object of the present invention is to provide a blade cleaning device including a cleaning blade which may be moved in a direction different from the direction of movement of a surface to be cleaned thereby allowing efficient cleaning operation without causing significant wear to either the blade or the surface.

A still further object of the present invention is to provide a self-adjusting blade cleaning device which is easy to manufacture and does not require special skills and experiences in assembly and maintenance.

A still further object of the present invention is to provide a blade cleaning device which is suitable for use in electrophotographic copying machines and the like.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3 is a front view of the device shown in FIG. 2;

FIG. 4 is a schematic illustration showing the positional relation of the holes formed in the side plate of the device shown in FIGS. 2 and 3;

FIG. 5 is a schematic illustration showing a blade cleaning device constructed in accordance with a second embodiment of the present invention;

DESCRIPTION OF THE PREFERRED EMBODIMENTS

Figure 1:
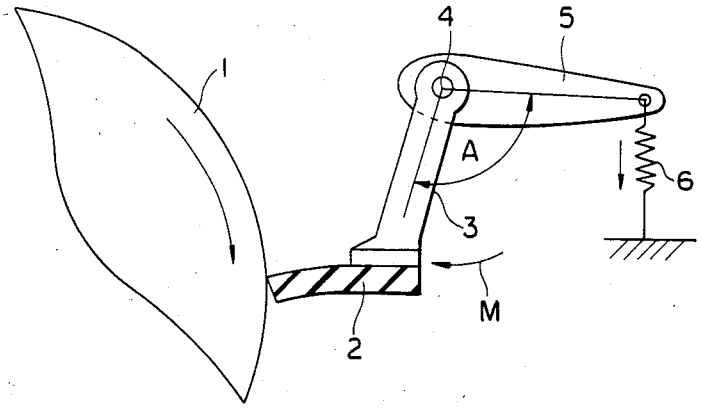
Fig. 1 PRIOR ART
FIG. 1 is a schematic illustration showing the typical prior art blade cleaning device.
Figure 2:
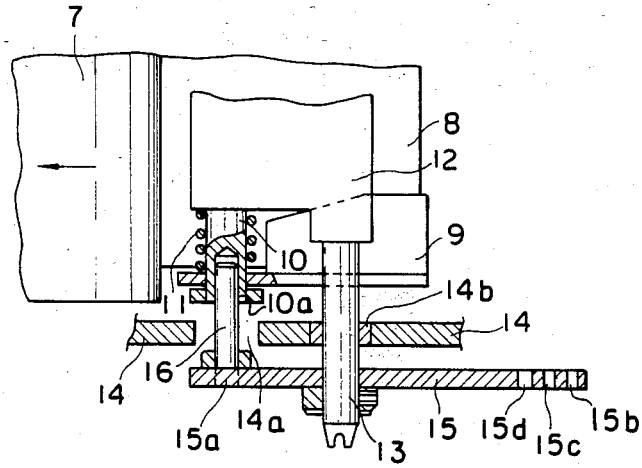
FIG. 2 is a partially cross-sectional, fragmental plan view showing part of a blade cleaning device constructed in accordance with one embodiment of the present invention.

Referring now to FIGS. 2 and 3, showing the blade cleaning device constructed in accordance with one embodiment of the present invention as applied to an electorphotographic copying machine, there is provided a photosensitive drum 7 which includes a photoconductive layer formed around the outer peripheral surface of a drum and which is supported to be driven to rotate in the direction indicated by the arrow. Although not shown, it should be understood that various electrophotographic image forming components are disposed around the drum 7 to form a toner image on the surface of the drum 7, which is then transferred to a transfer medium. After image transfer, there remain residual toner particles on the surface of the drum 7 and the present blade cleaning device is to remove these toner particles from the drum surface to prepare the drum surface for the next imaging cycle. Thus, here, the drum surface constitutes a surface to be cleaned by the present blade cleaning device.

The present blade cleaning device includes a blade 8 comprised, for example, of an elastic material such as rubber with its one end in pressure contact with the drum surface and the other end supported by a first supporting member 9. An intermediate shaft 10 is rotatably supported by the first supporting member 9, and the intermediate shaft 10 is also rotatably supported by a second supporting member 12. A coil spring 11 is provided as fitted onto the intermediate shaft 10 and, as shown in FIG. 3, one end of the coil spring 11 is in engagement with the first supporting member 9 with the other end engaged with the second supporting member 12 thereby imparting a spring force to the first and second supporting members 9 and 12 with an inclination to increase an angle B formed therebetween.

From the second supporting member 12 extends a shaft 13 which is rotatably supported by a bearing **14*b* fitted in a hole of a side plate 14 forming part of the machine housing. As shown in FIG. 2, the shaft 13 extends through the side plate 14, and a generally L-shaped pressure lever 15 is rotatably mounted at the end of the shaft 13 approximately at its center. One end of the pressure lever 15 and the end surface of intermediate shaft 10 are provided with supporting holes 15*a* and 10*a*, respectively, having the same diameter and being centrally aligned. The side plate 14 present between the pressure lever 15 and the intermediate shaft 10 is also provided with a through-hole 14*a* with its center being aligned with the centers of the holes 15*a* and 10*a*; however, the hole 14*a* is much larger in size as compared with the holes 15*a* and 10*a*, and, as shown in FIG. 4, is approximately two to three times larger in diameter. It is also to be noted that the hole 14*a* is disposed such that the blade 8 comes into pressure contact with the peripheral surface of the drum 7 at a desired position. A connection pin 16 is provided with its both ends planted in the supporting holes 10*a* and 15*a*, respectively, so that the pin 16 is loosely fitted in the hole 14*a* of side plate 14 to limit the movement of the blade 8**.

At the end opposite to the end where the hole **15*a* is formed, an engaging hole 15*b* is formed in the pressure lever 15, and a spring 17 is provided with its one end engaged with the hole 15*b* and its the other end engaged with a stationary object 18 such as the machine housing. Thus, due to the force of the spring 17, the pressure lever 15 is normally biased clockwise so that that end of the pressure lever 15 which is pulled by the spring 17 receives a force $F_1$, and, therefore, there is produced a moment M determined as a product of this force $F_1$ and the distance $l_1$ between the hole 15*b* and the rotating axis of shaft 13 in the direction indicated by the arrow. This moment is transmitted to the blade 8 through the second and first supporting members 12 and 9, so that the blade 8 comes in pressure contact with the surface of drum 7 with a force $F_2$. It is to be noted that more than one such engaging hole may be provided in the pressure lever 15. In the illustrated embodiment, two more such engaging holes 15*c* and 15*d* are provided to the left of the hole 15*b* thereby defining distances $l_2$ and $l_3$ from such holes, respectively, to the rotating axis of 13. Accordingly, by selectively using one of the holes 15*b* through 15*d* for engagement with one end of the spring 17, the magnitude of moment M may be variably set in three levels. In connection therewith, the level of force $F_2$ applied by the blade 8 against the surface of the drum 7** may also be variably set.

With the above-described supporting structure for operatively supporting the blade 8, in which the pressure lever 15 and the second supporting member 12 are integrated as a unit by means of the connection pin 16 and the shaft 13, the pressure lever 15 and the second supporting member 12 are only allowed to pivot as a unit around the rotating axis of the shaft 13 over an angle D which is determined by the diameter C of hole **14*a* and the diameter of pin 16. This structure allows limiting the movement of blade 8 with respect to the surface of drum 7 and to insure that an unacceptably excessive force is prevented from being applied by the blade 8 to the surface of drum 7**. As a result, this invention provides a self-adjusting structure once assembled, thereby easing manufacture and eliminating the necessity of precise adjustments in maintenance.

In operation, as the photosensitive drum 7 rotates to have residual toner particles transported as riding on its surface, the residual toner particles come to be scrubbed by the blade 8 to be scraped off the drum surface. Since the blade 8 is pressed against the surface of drum 7 by means of the springs 17 and 11, the blade 8 receives a force $F_3$ due to friction against the surface of drum 7 in the direction in which the blade 8 tends to be lifted upward. Of course, the larger the amount of residual toner particles on the surface of drum 7, the higher the magnitude of force $F_3$. However, this force $F_3$ is counterbalanced by a recovery force $F_4$ applied by the coil spring 11, so that the blade 8 may be maintained in pressure contact with the surface of drum 7 appropriately. In other words, with the structure of the illustrated embodiment, fluctuations in the force $F_3$ mainly caused by the fluctuations in the amount of residual toner particles on the surface of drum 7 are counteracted by the spring force $F_4$ of coil spring 11 and thus the pressing force $F_2$ may be maintained at an appropriate level determined by the spring 17. Thus, the blade 8 may be kept in pressure contact with the surface of drum 7 at an appropriate level at all times. Put another way, excellent cleaning effects may be maintained irrespective of the amount of residual toner particles to be cleaned.

FIG. 5 shows another embodiment of the present invention and like numerals are used to indicate the same elements as in the previous embodiment. This embodiment includes a generally L-shaped second supporting member 12' and a generally straight pressure lever 15' which is different from the previous embodiment in which the second supporting member 12 is generally in the shape of a flat plate and the pressure lever 15 is generally in the shape of "L". A connection pin 16' is provided as its one end planted in the free end of the L-shaped second supporting member 12' and the other end planted generally in the center of the straight pressure lever 15'. Other than these exceptions, the embodiment shown in FIG. 5 is structurally the same as the previous embodiment shown in FIGS. 2 and 3. Thus, this embodiment also possesses the self-adjusting feature similar to the previous embodiment just described.

Figure 6:
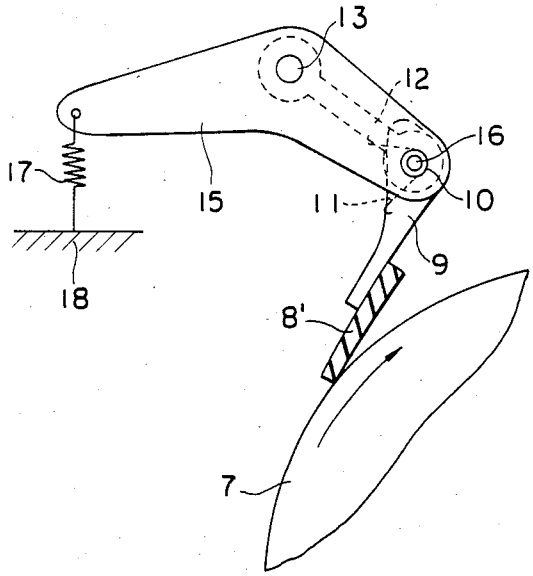
FIG. 6 is a schematic illustration showing a third embodiment of the present cleaning device.

FIG. 6 shows a further embodiment of the present invention. This embodiment is very similar in structure to the embodiment shown in FIGS. 2 and 3 excepting that the blade 8' is disposed in the so-called counterarrangement. And, thus, the blade 8' is provided to be in pressure contact with the surface of drum 7 with its cleaning edge surface facing in the direction opposite to the direction of movement of the drum surface at the contact therebetween.

Figure 7:
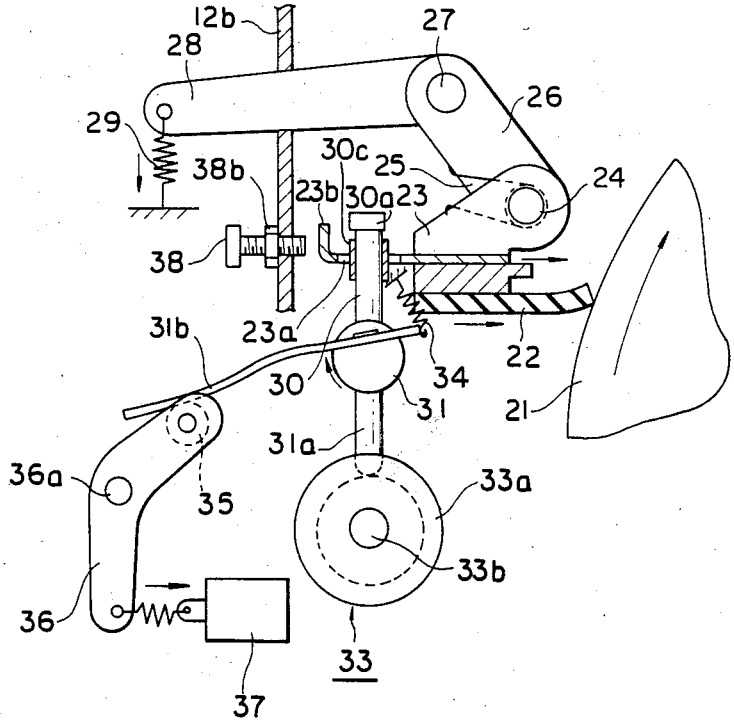
FIG. 7 is a schematic illustration showing a blade cleaning device constructed in accordance with a fourth embodiment of the present invention such that the blade may be moved in a direction other than the direction of relative movement between the blade and a surface to be cleaned in a reciprocating manner.

FIG. 7 shows a cleaning device constructed in accordance with another aspect of the present invention in which a cleaning blade is provided to be movable relative to the surface of a photosensitive drum while keeping pressure contact therebetween and/or separated away therefrom and closer thereto. As shown in FIG. 7, there is provided a photosensitive drum 21 which may be driven to rotate in the direction indicated by the arrow as in the previous embodiments. The cleaning device includes a blade 22 which is fixedly attached to a first supporting member 23 and which has one end thereof kept in pressure contact with the surface of drum 21. The first supporting member 23 is rotatably connected to an intermediate shaft 24 which, in turn, is rotatably connected to a second supporting member 26. Similarly with the previous embodiments, a coil spring 25 is loosely fitted onto the intermediate shaft 24 and has its opposite ends engaged with first and second supporting members 23 and 26, respectively, such that the coil spring 25 normally biases the first and second supporting members 23 and 26 to be separated away from each other.

The second supporting member 26 is fixedly mounted on a shaft 27 which is rotatably supported by the machine housing, for example, as journaled to its side plates. At one end of the shaft 27 is fixedly mounted a pressure lever 28 which has its one end engaged with one end of a spring 29 whose other end is engaged with a stationary object such as the machine housing. Thus, the above-described structure for supporting the blade 22 is very similar to the structure of the previously described embodiments. Of importance is the fact that, in addition to the spring 29 which basically determines the level of the pressing force applied by the blade 22 to the surface of drum 21, the coil spring 25 provided between the first and second supporting members 23 and 26 serves to absorb any fluctuations, thereby allowing to keep the contact between the blade 22 and the surface of drum 21 in an appropriate state at all times.

Figure 9A:
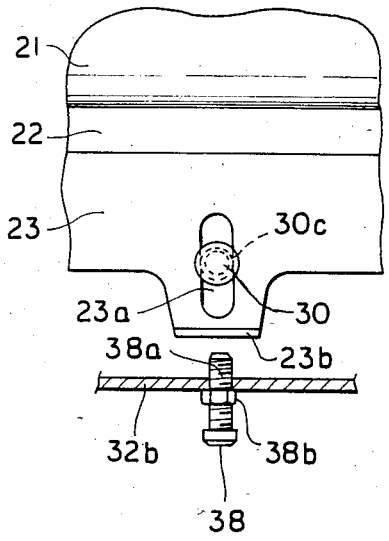
FIGS. 9*a* and 9*b* are fragmental plan views showing part of the structure of the embodiment shown in FIGS. 7 and 8 with the blade located at two different positions, one in contact with and the other out of contact with the imaging surface.
Figure 9B:
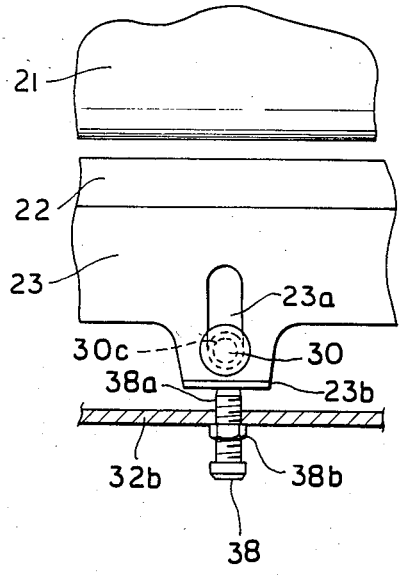

The first supporting member 23 is provided with a slot 23*a* generally at its middle, and an engaging pin 30 having a collar 30*c* is movably fitted into the slot 23*a*. The engaging pin 30 has an enlarged head 30*a* which is larger than the width of the slot 23*a* to prevent disengagement between the first supporting member 23 and the engaging pin 30. The engaging pin 30 has a base portion 30*b* at the end opposite to the top end where the head 30*a* is formed threaded into a driving shaft 31 which extends in parallel with the blade 22 under the first supporting member 23. The driving shaft 31 is rotatably supported by side plates 32*a* (only one being shown) of the machine housing such that it may also move along its longitudinal axis. The first supporting member 23 is also provided with a projection 23*b* which is partly bent in the middle of its trailing edge. A stationary plate 32*b* forming part of the machine housing extends vertically upward to the vicinity of the projection 23*b*. As best shown in FIGS. 9*a* and 9*b*, the stationary plate 32*b* is provided with a threaded hole 38*a* generally registered in position to the projection 23*b*, and an adjusting screw 38 is screwed into the threaded hole 38*a* in the direction toward the projection 23*b*. A nut 38*b* is also threaded onto the adjusting screw 38 so that the position of the screw 38 may be selectively fixed using this double-nut structure. When the screw 38 is selectively fixed in position, its bottom end determines how far the blade 22 is moved as separated away from the surface of drum 21 since the blade is moved away from the drum 21 until its projection 23*b* comes into abutment against the bottom end of screw 38.

Figure 8:
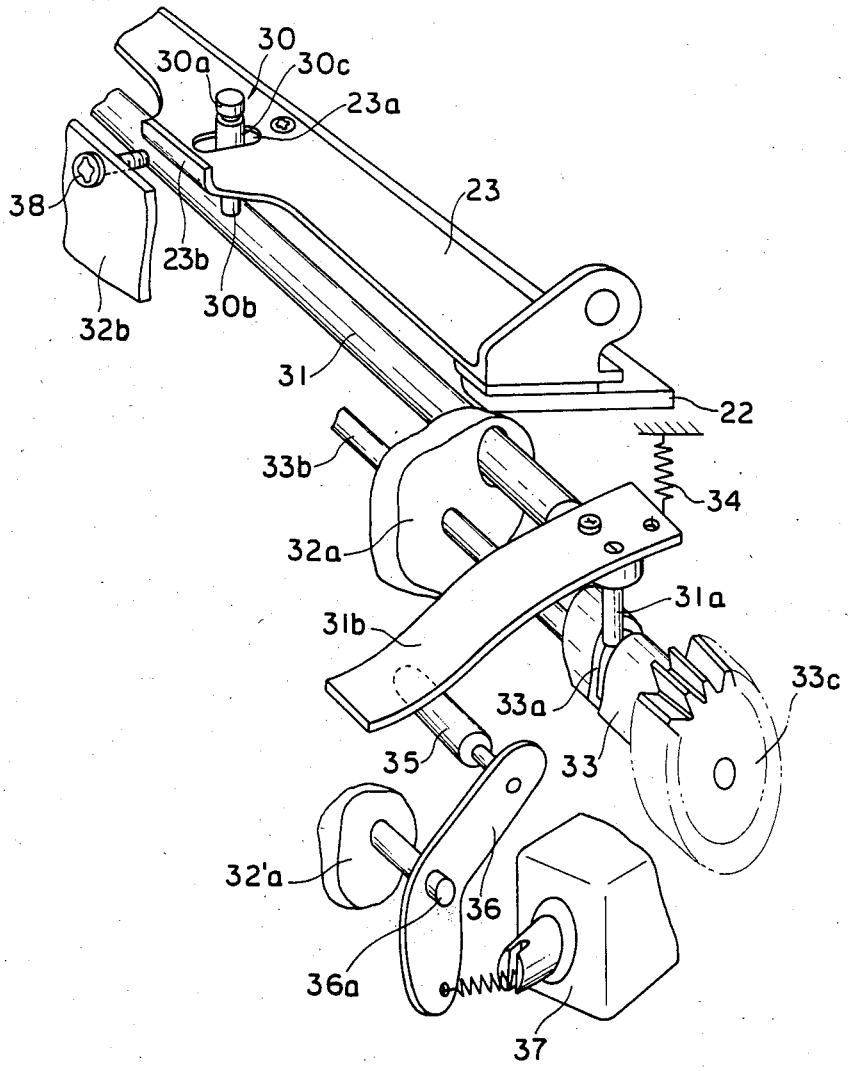
FIG. 8 is a perspective view showing the main structure of the device shown in FIG. 7.
Figure 10:
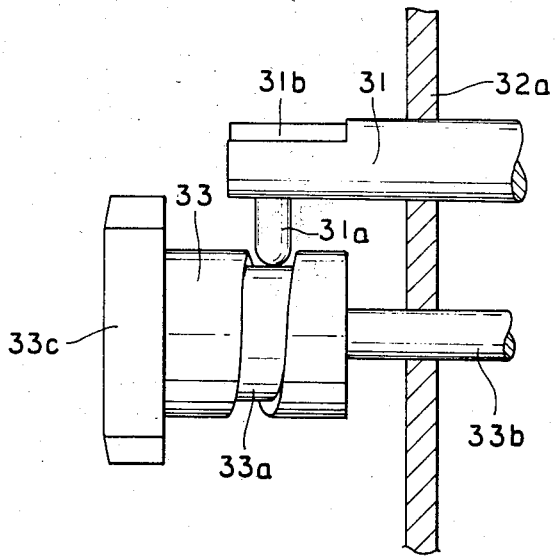
FIG. 10 is a schematic illustration showing another part of the embodiment shown in FIGS. 7 and 8.

As best shown in FIG. 8, the driving shaft 31 extends through the side wall 32*a*, and a driving pin 31*a* is provided as its one end planted in the driving shaft 31 and, moreover, an actuating plate 31*b* is provided with one end thereof fixedly attached to the driving shaft 31. As best shown in FIG. 10, the bottom end of driving pin 31*a* which extends downward from the driving shaft 31 is slidably received in a cam groove 33*a* formed in the peripheral surface of a cam cylinder 33 from which extends a shaft 33*b* which is rotatably supported by the side plate 32*a*. A driving gear 33*c* is also fixedly mounted on the shaft 33*b* beside the cam cylinder 33, and the driving gear 33*c* is operatively coupled to an external driving source (not shown).

As just described, the actuating plate 31*b* is fixedly attached to the driving shaft 31, and a spring 34 is provided as extended between one end of the actuating plate 31*b* and the machine housing. It is to be noted that, when actuated, spring 34 should cause the blade 22 to move away from the drum 21, and, thus, the spring force of spring 34 should be set substantially larger than that of spring 29, which is used to keep the blade 22 in contact with the drum 21. The actuating plate 31*b* extends substantially in the direction approximately perpendicular to the axis of driving shaft 31. In the vicinity of the free end of the actuating plate 31*b* is disposed a generally L-shaped actuating lever 36, and an engaging roller 35 is rotatably supported at one end of the actuating lever 36 to be engageable with the free end of the actuating plate 31*b*. The actuating lever 36 is fixedly mounted on a shaft 36*a* at its middle and the shaft 36*a* is rotatably supported by the side plate 12*a*' of the machine housing. On the other hand, the other end of actuating lever 36 is operatively connected to an electro-magnetic solenoid 37.

In operation, prior to the initiation of cleaning operation, the blade 22 is first brought into contact with the surface of photosensitive drum 21. In this case, as shown in FIG. 7, when the solenoid 37 is energized, the closer end of actuating lever 36 is attracted closer to the solenoid 37 as indicated by the arrow, thereby causing the actuating lever 36 to rotate counterclockwise as indicated by the arrow around the shaft 36*a*. This causes the actuating plate 31*b* to pivot clockwise against the force of spring 34 around and together with the driving shaft 31. At the same time, the driving pin 31*a* is moved around the driving shaft 31 so that its bottom end comes to be received in the cam groove 33*a*, and the engaging pin 30 comes to be located at the center of slot 23*a*, as shown in FIG. 9*a*. Thus, the first supporting member 23 is set operatively decoupled from the solenoid 37, and the blade 22 fixedly attached to the first supporting member 23 comes to be brought into pressure contact with the drum 21 at a predetermined pressure under the force of spring 29 extended between the pressure lever 28 and the machine housing.

To explain the foregoing in greater detail, as shown in FIG. 7, when the driving shaft 31 is rotated to bring the engaging pin 30 to its neutral position, the pressure lever 28 is forced to rotate counterclockwise around the shaft 27 under the force of spring 29, and, at the same time, the second supporting member 26 is also forced to rotate counterclockwise in unison. This causes the first supporting member 23, which is connected to the second supporting member 26 through the intermediate shaft 24 and the coil spring 25, to move in the direction indicated by the arrow so that the blade 22 fixedly attached to the first supporting member 23 is moved closer to the drum until its cleaning end surface is brought into contact at a predetermined pressure.

Then, through the external driving source (not shown), the driving gear 33*c* fixedly mounted on the shaft 33*b* is driven to rotate so that the cam cylinder 33 is also set in rotation. Since the cam groove 33*a* is sinusoidal in shape and the bottom end of the driving pin 31*a* is slidably received in the sinusoidal cam groove 33*a*, the driving pin 31*a* and thus the driving shaft 31 are moved back and forth along the longitudinal axis of driving shaft 31 in a reciprocating manner. As a result, the first supporting member 23 is also forced to move reciprocatingly along its longitudinal direction through the engagement between the driving pin 30 and the slot 23*a* of first supporting member 23. Since the blade 22 is fixedly attached to the first supporting member 23, it also executes a reciprocating motion while keeping a desired pressure contact with the surface of drum 21.

As described above, the blade 22 is moved in the direction other than the direction of movement of photosensitive drum 21 in a reciprocating manner with its cleaning edge in uniform pressure contact with the surface of drum 21. Under the condition, even if the amount of residual toner particles remaining on the surface of drum 21 fluctuates significantly, such fluctuations may be well absorbed by the coil spring 25 provided to impart a biasing force between the first and second supporting members 23 and 26 so that the blade 22 may be left in pressure contact with the surface of drum 21 at an appropriate pressure level.

Now, if it is desired to move the blade 22 separated away from the surface of drum 21, for example, during a period in which no cleaning of residual toner particles is required, the solenoid 37 is deenergized to allow the actuating lever 36 to rotate clockwise due to the counterclockwise rotation of the actuating plate 31*b* caused by the recovery force of spring 34. This causes the engaging pin 30 planted in the driving shaft 31 to come into engagement with one end of the slot 23*a* to bring the projection 23*b* in abutment against the bottom end of adjusting screw 38, as shown in FIG. 9*b*. Under the condition, the blade 22 is also moved away with its cleaning edge located so as to be separated from the surface of drum 21. As explained before, the distance of separation between the blade 22 and the surface of drum 21 may be adjusted by adjusting the set position of adjusting screw 38. Such a separation distance is preferably in the range between 0.5 mm and 1 mm so as to effectively prevent the collected toner particles from being scattered downstream with respect to the direction of rotation of drum 21.

It is to be noted that the counterclockwise rotation of driving shaft 31 under the recovery force of spring 34 also causes the driving pin 31*a* to be disengaged from the cam groove 33*a*. Thus, while the blade 22 is located at an inoperative position where it is not in contact with the drum 21, the blade 22 is not set in a reciprocating motion in the direction parallel with the rotating axis of drum 21.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A cleaning device for cleaning a surface comprising:

first supporting means pivotally supported by a frame of said device, said first supporting means including a shaft rotatably supported by the frame of said device, a first supporting member fixedly mounted on said shaft and a pressure lever mounted on said shaft integrally with said first supporting member;

second supporting means pivotally supported by said first supporting means;

a cleaning blade fixedly attached to said second supporting means;

first biasing means interposed between said first and second supporting means, said first biasing means biasing said first and second supporting means to move said blade closer to said surface;

second biasing means extended between said pressure lever of said first supporting means and the frame of said device, said second biasing means biasing said first supporting means to move said blade closer to said surface; and means for limiting the pivotal motion of said first supporting means over a predetermined angle, said means for limiting including a hole of predetermined size formed in the frame of said devide and a connection pin extended between said first supporting member and said pressure lever as passed through said hole.

2. A cleaning device of claim 1 wherein said pressure lever is connected to said second biasing means at different locations selectively so as to set the magnitude of moment applied by said second biasing means at a desired level.

3. A cleaning device of claim 1 wherein said first biasing means further comprises a coil spring having a first end engaged with said first supporting means and a second end engaged with said second supporting means.

4. A cleaning device of claim 3 wherein said second biasing means includes a spring.

5. A cleaning device of claim 1 wherein said blade is made of an elastic material.

6. A cleaning device of claim 5 wherein said blade is generally rectangular in shape and it is brought into contact with said surface substantially perpendicularly thereto.

7. A cleaning device of claim 5 wherein said blade is generally rectangular in shape and is brought into contact with said surface substantially inclined with respect thereto.

8. A cleaning device of claim 1 wherein said surface further comprises an imaging surface which is presented to an imaging process to form a toner image thereon, and said device is used to remove residual toner particles remaining on said surface after transfer of toner image to a transfer medium.

9. A cleaning device for cleaning a surface which is moving in a first direction, comprising:

a cleaning blade for cleaning said surface when brought into scrubbing contact with said surface;

supporting means for movably supporting said blade, said supporting means including first supporting means pivotally supported by a housing of said device and provided with a slot, second supporting means pivotally supported by said first supporting means, first biasing means interposed between said first and second supporting means for biasing said blade to move closer to said surface, and second biasing means extended between said second supporting means and said housing of said device for biasing said blade to move closer to said surface;

positioning means for positioning said blade selectively at a first position where said blade is in pressure contact with said surface or at a second position where said blade is separated away from said surface, said positioning means including a shaft slidably and rotatably supported by said housing of said device and planted with a pin engaged with said slot; and moving means for moving said blade in a second direction other than said first direction while said blade is located at said first position by said positioning means, said moving means causing said shaft to move axially in said second direction.

10. A cleaning device of claim 9 wherein said surface further comprises a peripheral surface of a photosensitive drum driven to rotate at constant speed in a predetermined direction.

11. A cleaning device of claim 9 wherein said cleaning blade is comprised of an elastic material.

12. A cleaning device of claim 9 wherein said first biasing means includes a coil spring having a first end engaged with said first supporting means and a second end engaged with said second supporting means.

13. A cleaning device of claim 9 further comprising adjusting means for adjusting the location of said second position.

14. A cleaning device of claim 13 wherein said adjusting means further comprises means for adjustment of position such that the distance of separation between said blade and said surface ranges from approximately 0.5 to 1 mm.

15. A cleaning device of claim 9 wherein said second direction is in a longitudinal direction of the contact line between said blade and said surface.

16. A cleaning device of claim 15 wherein said moving means further comprises means for moving said blade in a reciprocating manner.

* * * * *